United States Patent [19]

Iwahashi

[11] Patent Number: 4,540,275

[45] Date of Patent: Sep. 10, 1985

[54] CONTROLLING METHOD FOR TRANSFERRING AND SEPARATION IN A COPYING APPARATUS

[75] Inventor: Haruo Iwahashi, Hachioji, Japan

[73] Assignee: Konishiroku Photo Industry Co., Ltd., Tokyo, Japan

[21] Appl. No.: 445,996

[22] Filed: Dec. 1, 1982

[30] Foreign Application Priority Data

Dec. 3, 1981 [JP] Japan ..... 56-195146

[51] Int. Cl.[3] ..... G03G 15/16

[52] U.S. Cl. ..... 355/14 TR; 355/3 TR; 355/3 CH; 355/77

[58] Field of Search ..... 355/14 CH, 3 CH, 3 TR, 355/77, 14 TR; 430/126, 902, 33

[56] References Cited

U.S. PATENT DOCUMENTS

| | | | |
|---|---|---|---|
| 4,055,380 | 10/1977 | Borostyan | 355/3 TR |
| 4,183,653 | 1/1980 | Satomi et al. | 355/3 CH |
| 4,190,348 | 2/1980 | Friday | 355/3 CH |
| 4,234,249 | 11/1980 | Weikel | 355/14 CH |
| 4,341,457 | 7/1982 | Nakahata et al. | 355/3 TR |

*Primary Examiner*—R. L. Moses

*Attorney, Agent, or Firm*—Jordan B. Bierman

[57] ABSTRACT

The present invention provides for reduction of the copying time for a first copy in an electrophotographic copying apparatus, in that the area of the photoreceptor drum to be neutralized by the separation electrode is charged by the transferring electrode that is located immediately before the separation electrode.

2 Claims, 7 Drawing Figures

CONTROLLING METHOD FOR TRANSFERRING AND SEPARATION IN A COPYING APPARATUS

BACKGROUND OF THE INVENTION

1. Field of the Invention

The present invention relates to the controlling method for transferring and separation in an electrophotographic copying apparatus with an electrostatic separation system.

2. Description of the Prior Art

FIG. 1 shows a part of the rough constitution for the primary part of a copying apparatus wherein an image holder is formed in a drum shape, as an example of copying apparatus of this type. In this diagram, 1 is a photoreceptor drum having a photoreceptor layer of selenium or the like on the surface thereof and 2 is a charging electrode that causes the photoreceptor of the photoreceptor drum 1 to be charged by the corona discharge. The numeral 3 is an optical system that guides the reflected light corresponding to the original image on the platen (unillustrated) to the surface of the photoreceptor drum 1 and thus forms an electrostatic latent image, and 4 is a developing section that applies toner to the electrostatic latent image and thus forms a toner visible image. The numeral 5 is a first paper feeding roller that feeds out transfer paper loaded in the paper feeding cassette 6 to the prescribed position, and 7 is a second paper feeding roller that feeds out transfer paper so that the toner visible image on the surface of the photoreceptor drum 1 and the transfer paper are moved in synchronization. The numeral 8 is a transferring electrode that transfers the toner visible image on the drum surface to the transfer paper by means of corona discharge, 9 is a separation electrode that separates the transfer paper from the surface of the photoreceptor drum 1 by means of corona discharge and 10 is a transporting section that transports the transfer paper separated from the surface of the photoreceptor drum 1 to the fixing section 11. The numeral 12 is a cleaning section that cleans the toner remaining on the surface of the photoreceptor drum 1 and 13 is a preliminary exposure section that illuminates the entire surface of the photoreceptor drum 1 prior to the start of the copying cycle.

As one of the controlling methods around the photoreceptor drum 1 of the copying apparatus, there has been known a method wherein the photoreceptor drum 1 is rotated [FIG. 2(*a*)] concurrently with depressing the "ON" copy-button and at the same time, the actions of charging, copying and cleaning are started [FIG. 2(*b*)]. The aforesaid actions are stopped simultaneously after the completion of image formation. Copying in this case includes the processes of exposure, developing, transferring and separation. This controlling method has the merit that the control is simple, but it has the drawback that the discharging time of the electrode is long, contamination of the wire takes place in a short period of time, and the lamp to neutralize an electric charge in the area other than the image forming area should be provided against the photoreceptor drum 1 between the charging electrode 2 and the developing section 4 because charging is made continuously. As a controlling method to eliminate these drawbacks, there has been known a method wherein, as a timing chart for the interval of two copies in FIG. 3 shows, the photoreceptor drum 1 is rotated [FIG. 3(*a*)] and cleaning as well as preliminary exposure are made concurrently with the "ON" of the copy-button and later, charging is made [FIG. 3(*b*)] and further, the transferring and separation are made [FIG. 3(*c*)] after a certain period of time.

However, the aforesaid conventional controlling method has a common drawback that the first copy time cannot be shortened because the control of the neutralizing for transferring and separation is improper. This point is described as follows based on the results of experiments. First of all, if the leading edge of the image is at point $P_1$ that is just before the preliminary exposure section 13 in the former conventional example, a band-shaped low density area appears at the central portion of the image on the particular first copy (under the condition that a Se-Te drum with a diameter of 120 mm$\phi$ is used as a photoreceptor drum 1 and the line speed thereof is 150 mm/sec. and A3 is applied as a transfer paper size). Further, the measurement of the surface potential on the photoreceptor drum 1 at the point of the developing section 4 with the use of an original of solid black gives the characteristic curve shown in FIG. 4. The point A that is sharply dropped on the characteristic curve corresponds to the existence of the aforesaid low density area. The reason why the low density area appears is that the surface of the photoreceptor drum 1 that faces the separation electrode 9 when the copying is started is charged negatively by the AC discharge in the photoreceptor of the present example, and these negative charges are not removed by the preliminary exposure section 13 and are carried over to the next step. (What the preliminary exposure section 13 can do is only to bring the surface charged positively on the photoreceptor drum 1 close to OV.) Therefore, in this conventional example, the leading edge position needs to be selected of the point of $P_2$ which is positioned before the transferring electrode 8 and by doing so, the first copy time is made about 7.5 sec. The condition is quite the same even for the latter conventional example and if the leading edge position of the image is set at $P_1$, the first copy has an uneven density and even the second copy has a white band. Therefore, in the same manner as the former conventional example, the first copy time needs to be long.

SUMMARY OF THE INVENTION

The present invention has been devised in consideration of this problem and the reduction of the first copy time is obtained by causing the area to be neutralized by the separation electrode to be charged without fail by the preceding transferring electrode.

DETAILED DESCRIPTION OF THE PREFERRED EMBODIMENTS

The present invention will be explained in detail as follows.

Figure 1:
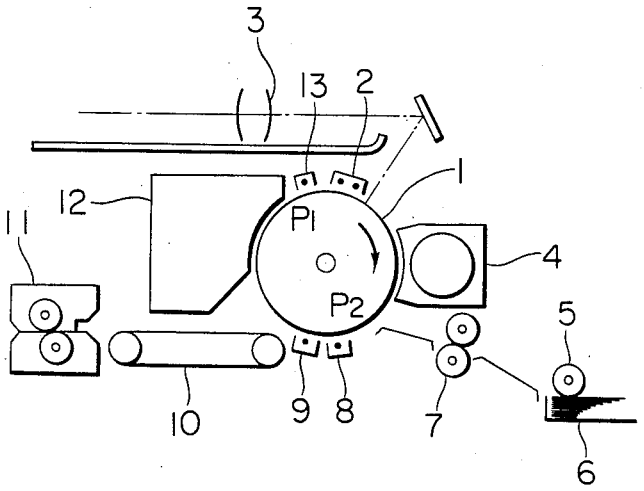
FIG. 1 is a side view of an electrophotographic copying apparatus showing a constitution of the photoreceptor and its surroundings.
Figure 2:
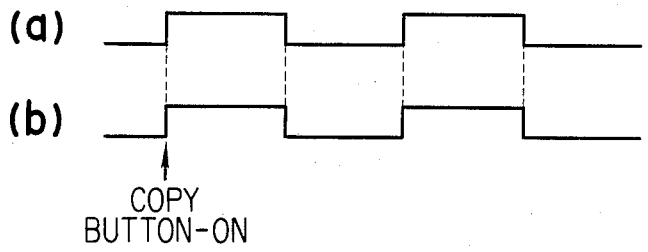
FIGS. 2, 3 and 4 are timecharts illustrating the controlling method around the photoreceptor drum.
Figure 5:
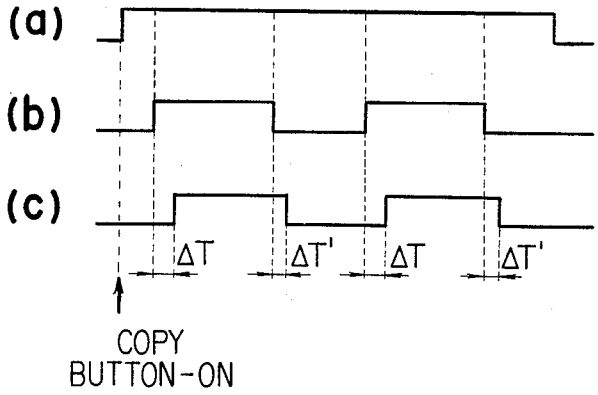
FIGS. 5, 6 and 7 are timecharts illustrating the controlling method according to the present invention.
Figure 6:
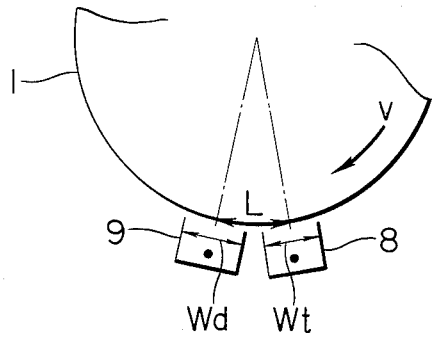

FIG. 5 is a timing chart showing an example of the present invention. FIG. 5(*a*) shows rotation of photoreceptor drum, FIG. 5(*b*) shows operation of the transferring electrode 8 and FIG. 5(*c*) shows operation of the separation electrode 9. The difference between the controlling method shown in FIG. 2 and the controlling method shown in FIG. 5 is that the start of the operation of the separation electrode 9 in the copying process is delayed by ΔT (sec.) after the start of the operation of the transferring electrode 8 or the like, and also the completion thereof is delayed by ΔT′ (sec.). The timing intervals ΔT (sec.) and ΔT′ (sec.) of the control signals that take charge of ON/OFF operation of the separation electrode 9 against ON/OFF operation of the transferring electrode 8 satisfy the following inequalities when, as shown in FIG. 6, the line speed of the photoreceptor is V (mm/sec.), the effective discharging widths of the transferring electrode 8 and the separation electrode 9 are Wt (mm) and Wd (mm), the distance between the aforesaid two electrodes 8 and 9 on the photoreceptor is L (mm) and the rise time of the two electrodes are Tt (sec.) and Td (sec.) respectively, and the breaking time of them are Tt′ (sec.) and Td′ (sec.) respectively.

$$\Delta T \geqq (L+Wd/2-Wt/2)/V+(Tt-Td)$$

$$0 \geqq \Delta T' \leqq (L+Wd/2-Wt/2)/V+(Tt'-Td')$$

Figure 3:
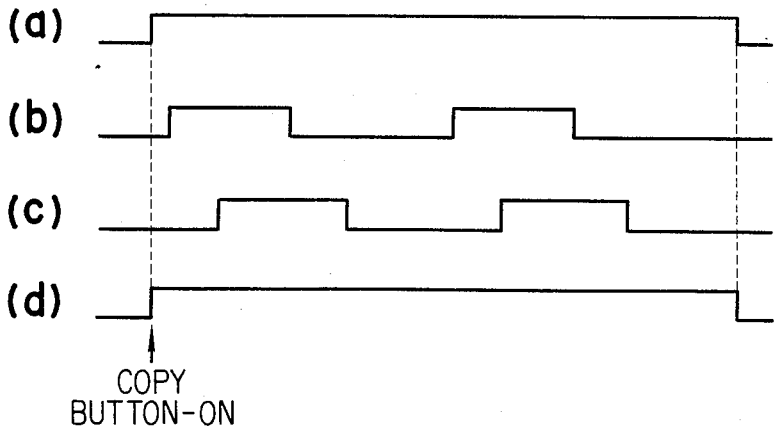
Figure 4:
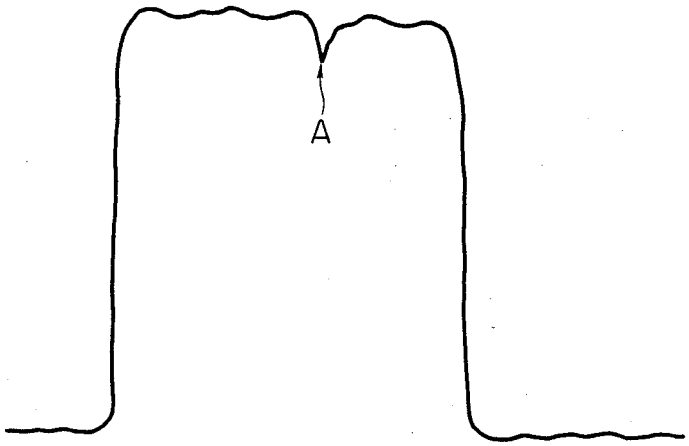
Figure 7:
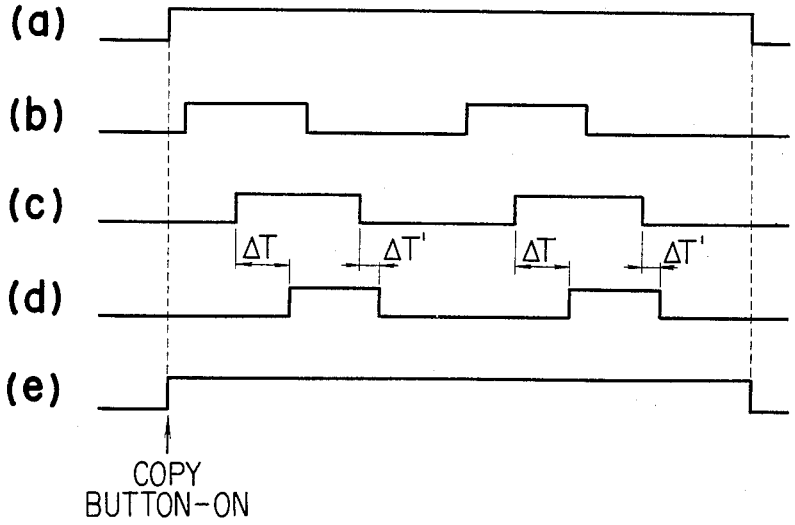

FIG. 7 is a timing chart for two copies showing another example of the present invention, wherein (a) shows rotation of the photoreceptor drum, (b) shows charging, (c) shows operation of transferring electrode, (d) shows operation of a separation electrode and (e) shows cleaning and exposure before charging. This is a timing chart wherein the problem shown in the timing chart for two copies in FIG. 3 is eliminated. ΔT and ΔT′ in the drawing are the same as ΔT and ΔT′ in FIG. 5. If the controlling is made with the use of this timing chart, the aforesaid density unevenness is eliminated and thereby the first copy time can be reduced.

Incidentally, in the aforesaid example, the method to control using two types of control signals with different timing is shown, but it is possible to control the transferring electrode 8 and the separation electrode 9 with a single control signal if, for example, the discharge rise time Td and breaking time Td′ on the separation electrode 9 are selected so that they satisfy the following inequalities.

$$Td \geqq (L+Wd/2-Wt/2)/V+Tt$$

$$0 \leqq Td' \leqq (L+Wd/2-Wt/2)/V+Tt'$$

Furthermore, the control signal can be supplied to the separation electrode 9 through the delay circuit as another possibility.

With the present invention method, as explained above, it is possible to realize a reduction of the first copy time because the photoreceptor drum will not be charged negatively even if its passes through the vicinity of the separation electrode.

What is claimed is:

1. A controlling method for transferring and separation of a transfer medium in an electrophotographic copying apparatus with an electrostatic separation system characterized in that an area to be neutralized by the separation electrode is charged by the transferring electrode that is located immediately before the separation electrode, wherein timing intervals ΔT (sec.) and ΔT′ (sec.) of the control signals that take charge of ON/OFF operation for the transferring electrode and the separation electrode satisfy the following inequalities when the line speed of the image holder is V (mm/sec.), effective discharge widths of the transferring electrode and the separation electrode are Wt (mm) and Wd (mm) respectively, discharge rise time for the transferring electrode and the separation electrode are Tt (sec.) and Td (sec.) respectively, breaking time are Tt′ (sec.) and Td′ (sec.) and the distance between two aforesaid electrodes on the image holder is L (mm):

$$\Delta T \geqq (L+Wd/2-Wt/2)/V+(Tt-Td)$$

$$0 \leqq \Delta T' \leqq (L+Wd/2-Wt/2)/V+(Tt'-Td').$$

2. A controlling method for transferring and separation of a transfer medium in an electrophotographic copying apparatus with an electrostatic separation system characterized in that an area to be neutralized by the separation electrode is charged by the transferring electrode that is located immediately before the separation electrode, wherein the aforesaid transferring electrode and separation electrode are controlled by a single controlling signal, a discharge rising time of said separation electrode Td and falling time Td′ are selected so that they satisfy the following inequalities:

$$Td \geqq (L+Wd/2-Wt/2)/V+Tt$$

$$0 \leqq Td' \leqq (L+Wd/2-Wt/2)/V+Tt'$$

where, V (mm/sec.) is the line speed of the image holder, Wt (mm) and Wd (mm) are effective discharge widths of the transferring electrode and the separation electrode respectively, Tt (sec.) and Td (sec.) are discharge rise times for the transferring electrode and the separation electrode respectively, T′t (sec.) and T′d (sec.) are discharge breaking times for the transferring electrode and the separation electrode respectively and L (mm) is the distance between the two aforesaid electrodes on the image holder.

* * * * *